US006673307B1

(12) United States Patent
Lindholm et al.

(10) Patent No.: US 6,673,307 B1
(45) Date of Patent: Jan. 6, 2004

(54) METHOD OF MAKING CEMENTED CARBIDE

(75) Inventors: Mikael Lindholm, Hägersten (SE); Mats Waldenström, Bromma (SE); Mats Ahlgren, Täby (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/743,090

(22) PCT Filed: Jul. 5, 1999

(86) PCT No.: PCT/SE99/01223

§ 371 (c)(1),
(2), (4) Date: Mar. 28, 2001

(87) PCT Pub. No.: WO00/03049

PCT Pub. Date: Jan. 20, 2000

(30) Foreign Application Priority Data

Jul. 13, 1998 (SE) ..... 9802519

(51) Int. Cl.[7] ..... B22F 1/00
(52) U.S. Cl. ..... 419/18; 419/35; 419/32
(58) Field of Search ..... 419/14, 18, 35, 419/32; 427/217, 383.7

(56) References Cited

U.S. PATENT DOCUMENTS

| | | | | |
|---|---|---|---|---|
| 4,923,512 A | * | 5/1990 | Timm et al. | 419/15 |
| 5,151,107 A | * | 9/1992 | Cho et al. | 51/295 |
| 5,403,628 A | * | 4/1995 | Konig et al. | 419/14 |
| 5,505,902 A | | 4/1996 | Fischer et al. | 419/10 |
| 5,529,804 A | | 6/1996 | Bonneau et al. | 427/217 |
| 6,190,762 B1 | * | 2/2001 | Rodiger et al. | 264/432 |

FOREIGN PATENT DOCUMENTS

| | | |
|---|---|---|
| DE | 4340652 | 6/1995 |
| DE | 19601234 | 7/1997 |
| DE | 19725914 | 9/1998 |
| GB | 346473 | 4/1931 |
| WO | 9633830 | 10/1996 |
| WO | 9803690 | 1/1998 |
| WO | 9803691 | 1/1998 |
| WO | 9804373 | 2/1998 |

* cited by examiner

*Primary Examiner*—Daniel J. Jenkins
(74) *Attorney, Agent, or Firm*—Burns, Doane, Swecker & Mathis, LLP

(57) ABSTRACT

The present invention relates to a method of making a cemented carbide by mixing powder of WC and possibly other powders forming hard constituents and binder phase and pressing agent, drying, pressing and sintering whereby; the mixing is wet mixing with no change in grain size or grain size distribution of the hard constituent powders; the WC grains are coated with binder metal and deagglomerated prior to the mixing. The sintering is made by microwave sintering at 1325–1410° C. with a holding time of 5–15 min. As a result a cemented carbide with improved properties is obtained.

21 Claims, 1 Drawing Sheet

X4000

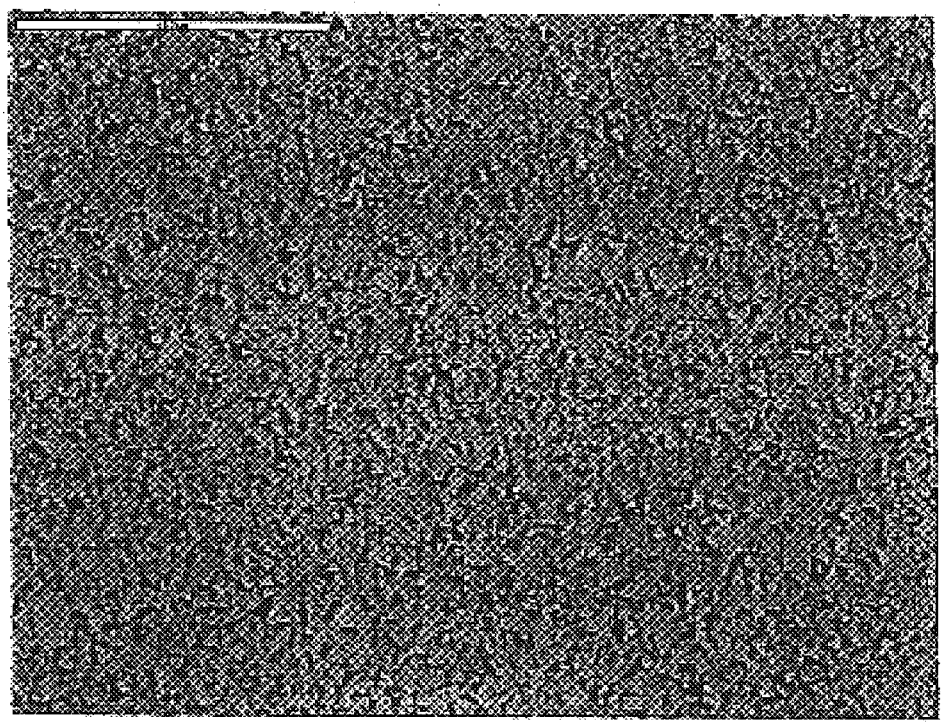
Fig. 1 X4000
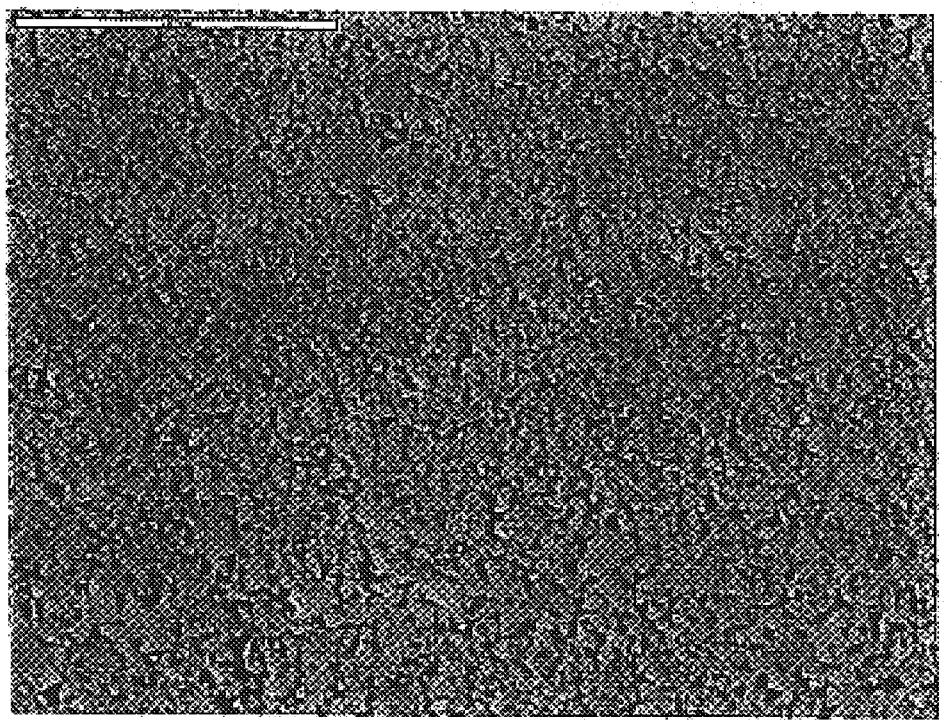
Fig. 2 X4000

METHOD OF MAKING CEMENTED CARBIDE

FIELD OF THE INVENTION

The present invention relates to a method of making cemented carbide. By combining microwave sintering and coating of the WC with binder phase and no milling a cemented carbide with extremely even structure is obtained.

BACKGROUND OF THE INVENTION

Cemented carbide is generally produced by powder metallurgical methods including milling of a powder mixture forming the hard constituents and the binder phase, pressing and sintering. The milling operation is an intensive milling in mills of different sizes and with the aid of milling bodies. The milling time is of the order of several hours up to several days. Such processing is believed to be necessary in order to obtain a uniform distribution of the binder phase in the milled mixture.

There exist alternative technologies to intensive milling for production of cemented carbide, for example, use of particles coated with binder phase metal. The coating methods include fluidized bed methods, solgel techniques, electrolytic coating, PVD coating or other methods such as disclosed in e.g. GB 346,473, U.S. Pat. No. 5,529,804 or U.S. Pat. No. 5,505,902. Coated carbide particles can be mixed with additional amounts of cobalt and other suitable carbide powders to obtain the desired final material composition, pressed and sintered to a dense structure. The sintering is generally made in electrical furnaces of continuous or batch type. Other methods also exist. One such method is microwave sintering known for some time, e.g., through DE 196 01 234, WO 96/33830 and WO 98/04373.

SUMMARY OF THE INVENTION

It has now surprisingly been found that cemented carbide bodies sintered in a microwave field made from powder mixtures with cobalt coated hard constituents with narrow grain size distributions and without conventional milling have a different structural profile including more narrow grain size distributions and less pronounced binder phase pools compared to corresponding powder mixtures sintered according to standard practice. Furthermore, it has been found that due to the very uniformly distributed binder phase on the carbide particles, it is possible to use microwave sintering with shorter sintering times and lower temperatures for the coated powders compared to conventionally milled powders and still get a dense structure.

According to one aspect, the present invention provides a method of making a cemented carbide comprising: providing a powder forming hard constituents; coating the hard constituent powder with binder phase material; deagglomerating the coated powder; wet mixing the coated powder with additional constituents such that no change in grain size or grain size distribution of the hard constituent powders is produced; drying the mixture; forming a green body with the dried mixture; and sintering the body in a microwave field at a temperature of 1325–1410° C. for approximately 5–15 minutes.

BRIEF DESCRIPTION OF THE DRAWINGS

FIG. 1 shows in 4000× magnification the microstructure of the cemented carbide according to the invention.

FIG. 2 shows a corresponding prior art sintered cemented carbide.

DETAILED DESCRIPTION OF THE INVENTION

According to the method of the present invention a cemented carbide is manufactured by jetmilling/sieving a WC-powder to a powder with desired narrow grain size distribution in which the grains finer than $d_{min}$ μm, and coarser than $d_{max}$ μm are eliminated. This WC powder is then coated with Co according to any of the above mentioned US-patents. The WC-powder is carefully wet mixed with other hard constituents if desired, possibly with more Co and pressing agent to a slurry with the desired final composition. It is essential that the mixing takes place without milling i.e. there shall be no change in grain size or grain size distribution as a result of the mixing. After mixing the slurry is dried to a powder from which bodies of desired shape are pressed. These bodies are then sintered by microwave sintering in an inert or controlled atmosphere or in vacuum followed by cooling. The sintering temperature shall be 1325–1410° C. and holding time 5–15 minutes. The cooling rate shall be as high as possible.

Because of the short sintering time there is essentially no grain growth and the microstructure of a cemented carbide made according to the invention is characterised by a WC grain size with the original range $d_{min}$–$d_{max}$ and essentially no grains larger than the original $d_{max}$-value. In addition the original extremely even binderphase distribution is preserved with no or less binder phase pools than obtained when sintering according to prior art.

The present invention is applicable to cemented carbides with varying amounts of binder phase and hard constituents. The binder phase may contain cobalt, nickel or mixtures thereof.

The WC-grains have a grain size in the range <5 μm, preferably 0.2–3 μm, most preferably <1 μm.

The amount of binder phase can vary between 2 and 25% by weight, preferably between 5 and 15% by weight. The amount of WC is between 98–55% by weight, preferably 95–65% by weight. The rest is γ-phase or other carbide phases.

In a first preferred embodiment the WC grains can have an extremely narrow distribution $d_{max}$–$d_{min}$<2 μm.

In a second preferred embodiment the WC is present in a bimodal or trimodal distribution.

In a third preferred embodiment the cemented carbide has a binder phase enriched surface zone.

The invention can be applied to all kinds of cemented carbide bodies such as inserts for metal cutting and rock drilling and wear parts.

The present invention will now be explained further by reference to the following examples, which are illustrative rather than restrictive.

EXAMPLE 1

Cemented carbide tool inserts of the type CNMG 120408-PM, an insert for turning, with the composition 10 wt % Co, 0.5 wt % $Cr_3C_2$, 0.3 wt % VC and rest WC were produced according to the invention from a jetmilled/sieved WC-powder with an average grain size of 0.6 μm and grain sizes in the range 0.2–0.9 μm. Cobalt coated WC, WC-2 wt % Co, prepared according to U.S. Pat. No. 5,505,902 was carefully deagglomerated in a laboratory jetmill equipment, mixed with additional amounts of Co and deagglomerated uncoated $Cr_3C_2$ and VC powders to obtain the desired material composition. The mixing was carried out in an ethanol and water solution (0.25 l fluid per kg cemented carbide powder) for 2 hours in a laboratory mixer and the batch size was 10 kg. Furthermore, 2 wt-% lubricant was added to the slurry. The carbon balance was adjusted with carbon black. After spray drying, the inserts were pressed. After pressing, the inserts were heated in a microwave field in vacuum to about 1300° C. followed by a step in protective atmosphere of Ar with a holding time of 10 minutes at 1350° C. After that, the cooling followed as normal furnace cooling with maintained protective atmosphere.

The structure of the inserts after microwave sintering consisted of a more evenly spread binder phase compared to conventionally sintered inserts. Furthermore, with comparable grain size and carbon contents the inserts had considerably lower Vickers hardness than conventionally produced products. A dense sintered structure with a porosity level in the range A00–A02 was obtained.

EXAMPLE 2

The same inserts as in example 1 were microwave sintered in the same manner as example 1 at a sintering temperature of 1410° C. The structure after sintering was essentially the same as in example 1, but got a little coarser average grain size and lower hardness. A dense sintered structure with a porosity level in agreement with example 1 was obtained.

EXAMPLE 3

As a reference the same powder mixture from the same process as in example 1 was used. Inserts were sintered according to a high pressure sintering cycle with a sintering temperature of 1350° C. and holding time 1 hour.

A dense sintered structure with a porosity level in agreement with example 1 was obtained. The structure and average grain size of the inserts was essentially identical to that of example 1 except for two aspects:

an apparent broader grain size distribution within the whole insert pronounced binder phase pools in the whole structure.

EXAMPLE 4

As a further reference inserts were pressed from the same powder mixture as in example 1 and sintered according to a conventional sintering cycle at 1410° C. and holding time 1 hour.

The structure of the inserts was essentially identical to that of example 1, 2 and 3 except for a somewhat larger grain size, lower hardness and less pronounced binder phase pools in the structure than example 3. A dense sintered structure with a porosity level in agreement with example 1 was obtained.

FIG. 1 shows in 4000× magnification the structure in a microwave sintered insert, sintered for 10 min at 1410° C. according to example 2, with narrow grain size distribution and no binder phase pools. FIG. 2 shows in 4000× magnification the structure of a corresponding conventionally sintered insert, sintered for 1 h at 1410° C. according to example 4, with an apparent broader grain size distribution and pronounced binder phase pools.

While the present invention has been described by reference to the above mentioned embodiments, certain modifications and variations will be evident to those of ordinary skill in the art. Therefore, the present invention is to be limited only by the scope and spirit of the appended claims.

What is claimed is:

1. A method of making a cemented carbide comprising:

providing a powder forming hard constituents;

coating the hard constituent powder with binder phase material;

deagglomerating the coated powder;

wet mixing the coated powder with additional constituents such that no change in grain size or grain size distribution of the hard constituent powders is produced;

drying the mixture;

forming a green body with the dried mixture; and sintering the body in a microwave field at a temperature of 1325–1410° C. for approximately 5–15 minutes.

2. The method according to claim 6, wherein the WC-powder has a narrow grain size distribution such that $d_{max}-d_{min}<2$ μm.

3. The method according to claim 5, wherein the WC-powder has a biomodal grain size distribution.

4. The method according to claim 5, wherein the cemented carbide has a binder phase enriched surface zone.

5. The method of claim 1, wherein the hard constituents comprise WC.

6. The method of claim 1, wherein the binder material comprises Co, Ni, or mixtures thereof.

7. The method of claim 5, wherein the WC powder has grain sizes in the range of 0.2–0.9 μm, and an average grain size of 0.6 μm.

8. The method of claim 1, wherein the additional constituents comprise additional binder materials and a pressing aid.

9. The method of claim 8, wherein the additional constituents further comprise a source of carbon.

10. A method of making a cemented carbide comprising:

providing a carbide powder;

coating the carbide powder with binder phase material;

deagglomerating the coated powder;

wet mixing the coated powder with additional constituents such that no change in grain size or grain size distribution of the hard constituent powders is produced;

drying the mixture;

forming a green body with the dried mixture; and sintering the body in a microwave field at a temperature of 1325–1410° C. for approximately 5–15 minutes.

11. The method according to claim 10, wherein the carbide powder has a narrow grain size distribution such that $d_{max}-d_{min}<2$ μm.

12. The method according to claim 10, wherein the carbide powder has a biomodal grain size distribution.

13. The method according to claim 10, wherein the cemented carbide has a binder phase enriched surface zone.

14. The method of claim 10, wherein the carbide powder comprises WC.

15. The method of claim 10, wherein the binder material comprises Co, Ni, or mixtures thereof.

16. The method of claim 10, wherein the carbide powder has grain sizes in the range of 0.2–0.9 μm, and an average grain size of 0.6 μm.

17. The method of claim 10, wherein the additional constituents comprise additional binder materials and a pressing aid.

18. The method of claim 1, wherein the step of forming a green body comprises pressing the dried mixture.

19. The method of claim 10, wherein the step of forming a green body comprises pressing the dried mixture.

20. The method of claim 5, wherein the body is sintered at a temperature of at least 1350° C.

21. The method of claim 10, wherein the body is sintered at a temperature of at least 1350° C.

* * * * *